United States Patent [19]

Alcalay

[11] 4,066,004

[45] Jan. 3, 1978

[54] OSCILLATORY ELECTRO-HYDRAULIC SYSTEM

[75] Inventor: Joseph Alcalay, Kenosha, Wis.

[73] Assignee: J. I. Case Company, Racine, Wis.

[21] Appl. No.: 702,479

[22] Filed: July 6, 1976

[51] Int. Cl.[2] ..... F01B 15/00; F01L 25/08; F15B 13/06

[52] U.S. Cl. ..... 91/183; 91/176; 91/275; 91/412; 91/447

[58] Field of Search ..... 91/275, 189, 171, 183, 91/176, 412, 447; 214/762

[56] References Cited

U.S. PATENT DOCUMENTS

| | | | |
|---|---|---|---|
| 3,133,653 | 5/1964 | Anderson | 91/189 |
| 3,355,993 | 12/1967 | Williomson | 91/171 |
| 3,489,063 | 1/1970 | Piret | 91/275 |

*Primary Examiner*—Paul E. Maslousky
*Attorney, Agent, or Firm*—Arthur J. Hansmann

[57] ABSTRACT

An oscillatory electro-hydraulic system for a material handling bucket and including two hydraulic cylinder assemblies connectable with the bucket for tipping the bucket, and including a hydraulic pump and control valve and pressure relief valve and a reducing valve, all for directing flow to the respective cylinder assemblies. An electric system is interconnected with the assemblies and with one of the control valves, for controlling the flow of fluid to one of the two cylinder assemblies.

13 Claims, 4 Drawing Figures

OSCILLATORY ELECTRO-HYDRAULIC SYSTEM

This invention relates to an oscillatory electro-hydraulic system for a material handling bucket, such as the arrangement utilized in connection with a tractor having a loader or material handling bucket which is pivotally controlled by means of hydraulic cylinders.

BACKGROUND OF THE INVENTION

The prior art is already aware of various arrangements of hydraulically-controlled pivotal buckets supported on a tractor or the like. These prior art arrangements commonly have hydraulic pumps and valves and cylinder assemblies, all for pivotally controlling and positioning the bucket, for the purpose of digging and loading and dumping the bucket. One example of such prior art is seen in U.S. Pat. No. 3,084,817 where an oscillatory digger is disclosed, and the present invention also relates to an oscillatory type of arrangement for the material handling bucket.

Accordingly, it is an object of this invention to provide an oscillatory electro-hydraulic system for a material handling bucket wherein the bucket can be completely and accurately controlled by means of the hydraulic power applied through cylinder assemblies connected with the bucket. Further, the present invention incorporates an electric system wherein the two cylinder assemblies employed in pivoting the bucket are pressurized according to the extension and contraction of the assemblies which control the electric system in the extending and contracting action itself. In this arrangement, the present invention employs two cylinder assemblies which are pressurized by means of a hydraulic pump and which have a valve interposed between the assemblies for selective directing of fluid pressure between the two cylinder assemblies, and the arrangement is such that only one of the two assemblies can be actuated for pivoting the bucket, while the other of the two assemblies can simply be free to extend or contract in response to the pressurizing and actuation of the first cylinder assembly.

That is, the present invention provides an oscillatory electro-hydraulic system wherein two cylinder assemblies are available but only one of the two can be utilized, in one mode of operation, and the two assemblies can be operative, in another mode of operation, when it is desired that the oscillatory action be effected in the control of the material handling bucket. In accomplishing this, the electric system is incorporated in the overall arrangement and is responsive to the extension and contraction of the cylinder assemblies, and the electric system is electrically connected with a hydraulic valve to thereby control the flow to one of the two cylinder assemblies, when it is desired that the additional one of the two assemblies be pressurized for pivoting of the bucket. Further, it will be seen and understood that the entire arrangement of the electro-hydraulic system disclosed herein can be applied to the conventional loader bucket, back-hoe, and like arrangements where the member holding the material is pivotally mounted and under the influence of hydraulic cylinders, as employed herein.

Another object of this invention is to provide an oscillatory electro-hydraulic system which incorporates the aforementioned alternative actions of pressurizing only one of two cylinder assemblies or of pressurizing both of the cylinder assemblies, with the latter action being utilized in the oscillatory mode of operation of the entire system. Further, in accomplishing this particular objective, the oscillatory mode is automatically repeated, and it is shown herein to be controlled by an electric system wherein the operator need only push an electric stop button in order to deactivate the oscillatory mode of this invention. Still further, the energizing or de-energizing of the oscillatory mode can be accomplished at any point in the cycle of the operation of the cylinder assemblies.

Other objects and advantages will become apparent upon reading the following description in light of the accompanying drawings.

DETAILED DESCRIPTION OF THE PREFERRED EMBODIMENT

Figure 1:
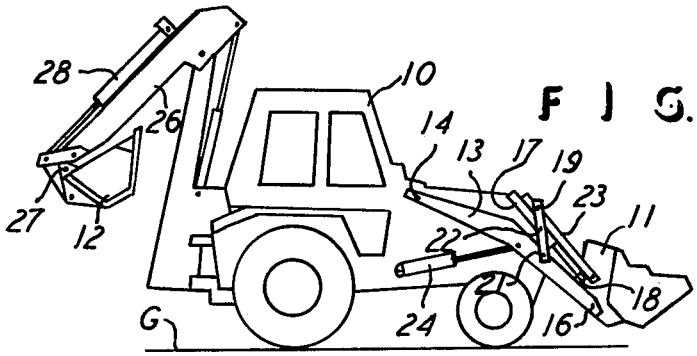
FIG. 1 is a side elevational view of a conventional arrangement of a tractor with a loader bucket and a back-hoe supported thereon.

FIG. 1 shows a conventional arrangement of a tractor 10 mobile on the ground designated G and supporting a loader bucket 11 and a back-hoe bucket 12, all in a conventional arrangement. The laoder bucket 11 is supported on arms extending along opposite sides of the front portion of the tractor 10, such as the shown arm 13 which is pivoted on the tractor at the point designated 14. The bucket 11 is pivoted on the forward end of the arm 13 at the point designated 16, and thus the bucket can pivot fore-and-aft relative to the tractor 10, all in a conventional manner. A hydraulic cylinder assembly 17 is attached at its rod end to the arm 13 at the point designated 18 and an arm 19 is pivoted on the main arm 13 at a point designated 21, and the cylinder 17 is also pivoted on the arm 18 at a point designated 22. Finally, a link 23 has its opposite ends pivotally connected to the bucket 11 and the arm 19 such that extension and contraction of the cylinder assembly 17 will cause the arm 19 to pivot about the point 21 and thereby move the link 23 and thus pivot the bucket 11, all in a conventional arrangement. Another cylinder assembly 24 is mounted on the tractor 10 and connects with the main arm 13, for pivoting the arm 13 up and down, in the usual arrangement.

It will also be understood by one skilled in the art that the backhoe bucket 12 is pivotal on a support arm 26, such as pivoting about a point designated 27, and the bucket 12 is controlled by the cylinder assembly 28 in the pivot action. Accordingly, in the conventional arrangement, hydraulic cylinder assemblies are utilized for pivoting the bucket members, such as the members 11 and 12.

Figure 2:
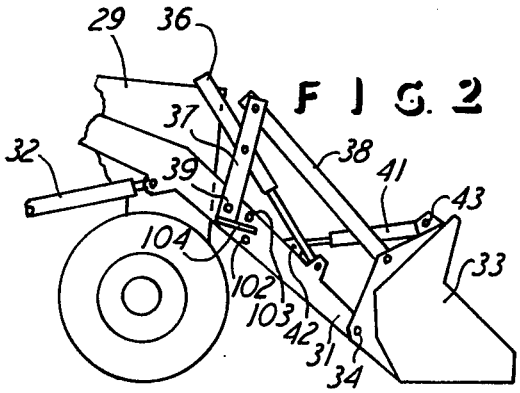
FIG. 2 is a side elevational view of the front fragment of a tractor and a loader bucket with the construction of this invention incorporated therein.

FIG. 2 shows the arrangement of a tractor designated 29 and having a main arm 31 under the influence of a cylinder assembly 32, and a material handling bucket 33 is pivoted about a point 34 on the forward end of the main arm 31, all as mentioned in connection with FIG. 1. Also, there is a cylinder assembly 36 and an arm 37 and a link 38, all pivotally connected together in the manner shown in FIG. 2, and thus extension and retraction of the assembly 36 will cause the arm 37 to pivot about its mounting point 39 and thereby displace the link 38 to pivot the bucket 33 about its mounting point 34, and this action can be used for loading or leveling or dumping the bucket 33, in the usual arrangement, such as that disclosed in connection with FIG. 1.

Additionally, FIG. 2 shows a cylinder assembly 41 which is pivotally connected to the arm 31 at the point designated 42 and which is pivotally connected to the bucket 33 at the point designated 43. Thus, extension and contraction of the assembly 41 will also cause pivotal movement of the bucket 33 about its pivot point 34, and the utilization of the two cylinder assemblies 36 and 41 will be more fully described in connection with FIG. 3. Therefore, as the construction is shown in FIG. 2, when the assembly 41 is extended, then the link 38 and arm 37 are moved, and that causes assembly 36 to retrack.

Figure 3:
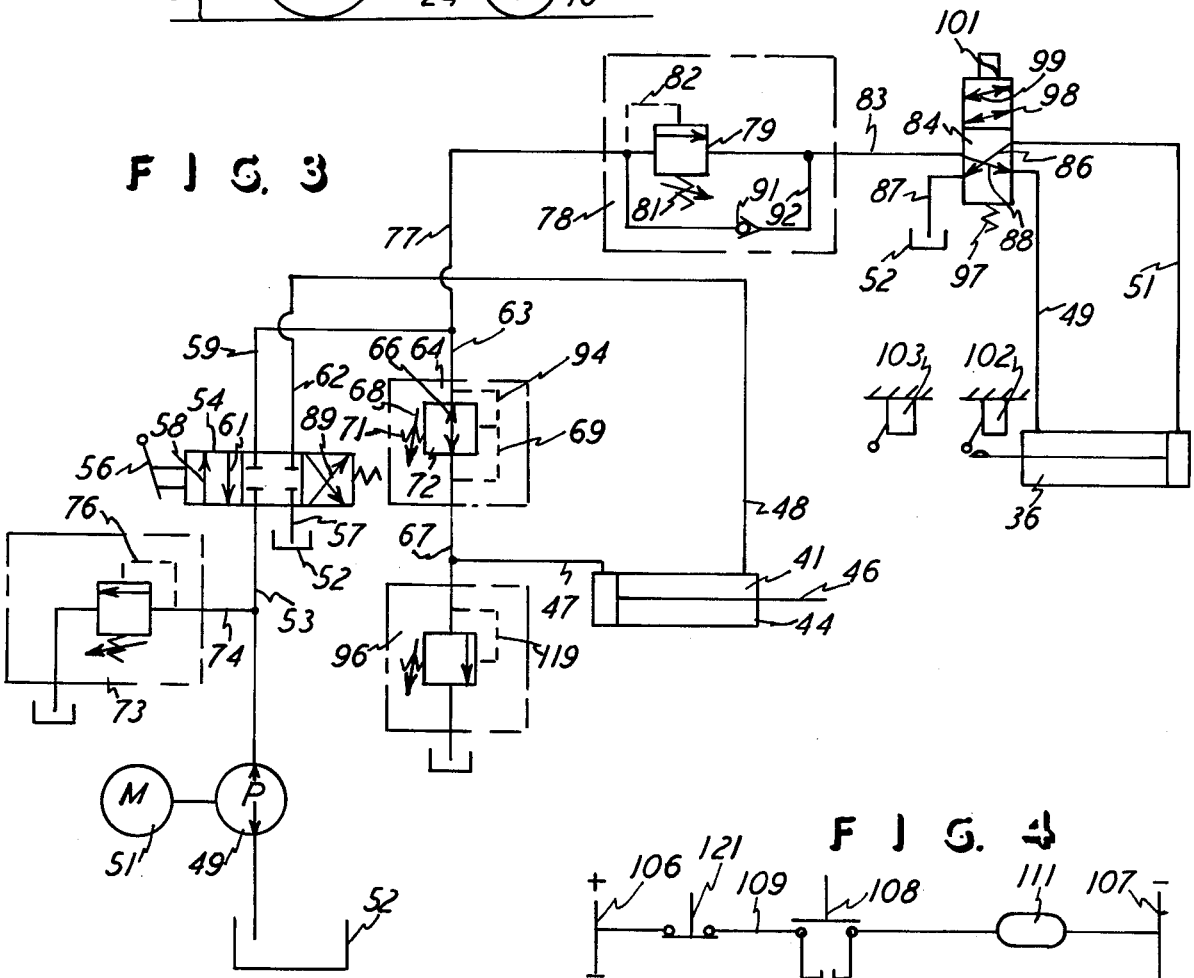
FIG. 3 is a schematic view of the hydraulic system of this invention, with the electric switches shown related thereto.

FIG. 3 shows the inventive arrangement of the hydraulic system which incorporates the two hydraulic cylinder assemblies 36 and 41 each of which includes a cylinder 44 and a piston rod 46 with the usual piston, all in a conventional assembly arrangement. Thus the assemblies have cylinder head ends and rod ends, and it is seen that both assemblies have their respective ends connected with hydraulic lines designated 47 and 48 and 49 and 51.

The hydraulic system also incorporates a hydraulic pump 49, suitably connected to and driven by a motor or prime mover 51, and having a hydraulic connection to a tank or fluid supply designated 52. Further, the other schematically-shown portions of the fluid supply or tank 52 are conventionally indicated on the drawing in the several locations shown. Thus a hydraulic line 53 extends from the pump 49 and to a four-way hydraulic valve 54 which is shown to be of a spool type and is shiftable through a control handle 56 operated by the operator. In the position shown in FIG. 3, of course there is no flow of hydraulic fluid from the pump 49 and through the valve 54, since the valve 54 is in a neutral position which simply has the oil or hydraulic fluid pumped back to the supply or tank through the line designated 57.

Shifting the control valve 54 to the right, as viewed in FIG. 3, hydraulically communicates the line 53 with the valve passageway 58 which in turn passes the fluid to the outlet line 59. Also, the valve passageway 61 is aligned with the line 57, for return to the tank for any oil coming from a line 62 with which the passageway 61 is aligned. Hydraulic pressure and flow in the line 59 passes to a line 63 which flow communicates with a pressure reducing valve 64 which is a normally open valve, as shown by its fluid passageway 66. Also, a line 67 communicates the valve 64 with the line 47 leading to the head end of the assembly 41. In that setting or mode, the assembly 41 is hydraulically pressured to extend the assembly, and this could cause the dumping of the bucket 33. Of course it will also be seen and understood that the fluid pressure in the rod end of the assembly 41 will move into the line 48 which is designated 62 at the valve 54, and thus the rod end of the assembly 41 is directed back to the tank 52.

When the assembly 41 is fully extended, due to the pressure in the head end thereof as described, the pressure in the line 67 increases until it exceeds the setting of the pressure in the reducing valve 64, and it will be seen and understood that the valve 64 can be selectively set for the pressure, by means of the selective adjustment characteristically shown by the arrow designated 68. This increased hydraulic pressure will be sensed by a pilot line 69 in the valve 64 and will thus shift the closure of the valve 64 to a position which closes the valve 64, and thus the valve 64 has shifted against the conventional spring 71 abutting the valve closure 72. With valve 64 closed, the pressure from the pump 49 is limited by a conventional type of pressure relief valve 73 which is connected to the line 53 by a line 74. Again the valve 73 is of an adjustable pressure type but is normally closed, though it has a pilot line 76 which causes the valve closure to shift to the open position when the pressure is of a sufficient magnitude to warrant opening of the valve 73 and relief of the pressure in the entire system. Thus the valve 73 is one of several pressure control or actuated valves shown in FIG. 3, and it is the one having the highest magnitude for pressure actuation or relief, and the valve 64 is the one of the several valves which has the lowest magnitude for pressure actuation, as will be more clearly seen hereinafter.

With the valve 64 closed, as described, the output from the pump 49 still being directed to the line 59 will be directed to the line 77 which leads to a pressure relief valve 78 having a closure 79 in the normally closed position, as established by the selective control and spring designated 81. The set actuating pressure for the valve 78 is a quantity somewhat less than that of the valve 73, and thus the valve 78, through its pilot line 82, will shift to an opening position under the influence of the hydraulic pressure which will then pass through the valve 78 and to a line 83 and into a control valve 84. Lines 49 and 51 are connected with the three-way control valve 84 which is normally open, and the valve has a hydraulic return passageway 86 in flow communication with the line 51 and with a line 87 leading to the tank or fluid supply designated 52. Thus the hydraulic fluid in the head end of the assembly 36 will simply return to the tank, and thus the assembly 36 can freely contract when the assembly 41 is extending, and thus the assembly 36 does not interfere with the dumping actuation of the cylinder assembly 41. Also, with the valve 84 in the position shown in FIG. 3, the pressure in the line 83 flow communicates with the valve passageway 88 which in turn communicates with the line 49 to direct the fluid pressure to the rod end of the assembly 36, and thus the assembly 36 is held in the contracted position, as desired for the dumping action.

At this time it should therefore be seen and noticed that the assemblies 36 and 41 are oppositely connected in that when the head end of the assembly 41 is pressurized then the rod end of the assembly 36 may be pressurized, and vice versa.

Next, for reversing the action described, shifting the four-way control valve 54 to the left, as viewed in FIG. 3, will fluid-flow communicate the valve passageway 89 with the pump line 53 and the line 62 and line end 48 to pressurize the rod end of the assembly 41. Of course the valve 54 is also then set in a position to have the line 59 directed to the line 57 and back to the tank or supply designated 52, as indicated. Such return flow in the line 59 is coming partly from the assembly 36 and through the line 49 and line 83 and through the check valve 91 in the line 92 which returns the fluid to the line 77 and then to the line 59. Also, fluid pressure in the head end of the assembly 41 is presented to the line 47 and line 67, and that pressure can be relieved through a small relief line 94 which flow communicates with the pilot line 69 in the reducing valve 64 to thereby permit the valve 64 to shift to its normally open position shown in FIG. 3. Thus the pressure at the head of the assembly 41 can return to the tank 52. During this operation, the assembly 36 can extend, since its rod end is no longer under fluid pressure, as explained, and thus again the extension and contraction of the assemblies 36 and 41 is in the opposite directions.

A pressure relief valve 96 is connected with the line 47, and the pressure magnitude of this valve is less than that of the valve 78, and, with valve 64 closed, fluid can go to the tank through valve 96 when the head end of assembly 41 is pressurized by the extension of assembly 36. The relative valve pressures are such that with the valve 73 having a pressure of a certain set magnitude, then the valve 78 may be provided with a pressure of 100 psi less than that magnitude, and the valve 96 may be provided with a pressure of 200 psi less than that magnitude, and the reducing valve 64 may be provided with a pressure of 400 psi less than that magnitude.

In this arrangement as described and shown in FIGS. 2 and 3, it will now be seen and understood that the cylinder assembly 41 can be pressurized at either end thereof, for either action of extension or contraction of the assembly 41, and the assembly 36 will permit and accommodate that action, but the assembly 36 will not be hydraulically pressurized until the full action of assembly 41 is accomplished. Also, it will be noticed that only a single line 77 extends between the assemblies 36 and 41, but the two lines 49 and 51 extend to the respective ends of the assembly 36. It will also be noticed that the three-way and normally open valve 84 is of a spool type under the influence of a compression spring 97, and the valve has passageways 98 and 99 and a solenoid unit designated 101. Energizing the unit 101 will cause the valve closure 84 to shift to where the passageway 98 flow communicates between the lines 49 and 87, and the hydraulic return passageway 99 flow communicates between the lines 83 and 51, with the return to the tank 52.

Further, FIGS. 2 and 3 show conventional electric limit switches 102 and 103, with those switches shown in FIG. 2 to be mounted on the arm 31 and adjacent an extension 104 on the lever 37, such that extension and contraction of the assembly 36 will cause the projection 104 to alternately engage the electric switches 102 and 103 for actuation of the switches as hereinafter described in connection with FIG. 4, and as indicated in FIG. 3 with the rod of the assembly 36 shown to be operatively related to the two switches for actuating the switches in the usual manner of actuating limit switches.

The aforementioned describes how the entire system is arranged such that only the cylinder assembly 41 is actually effective in the pivotal movement of the bucket 33, and the cylinder assembly 36 only permits and accommodates that action. The following describes the arrangement whereby both cylinder assemblies 41 and 36 can be powered for the purpose of oscillatory action on the bucket 36, such as desirable for digging and dumping or the like pivotal movement of the bucket 33.

Figure 4:
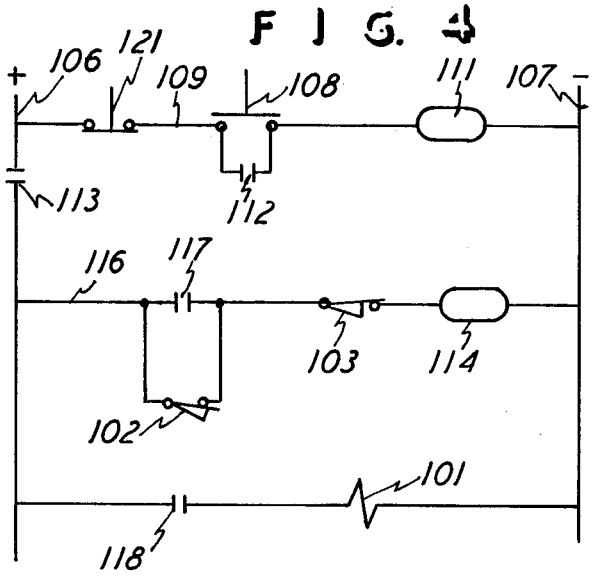
FIG. 4 is a schematic view of the electric system incorporated in this invention.

FIG. 4 shows the electric system which has the live electric lines 106 and 107 and a conventional electric start button 108 is connected with the lines 106 and 107 through the line 109. A control relay 111 is also connected in the line 109 and is of a conventional arrangement having the first set of electric contacts designated 112 and the second set of electric contacts designated 113. The arrangement is such that upon pushing the start button for switch 108, the control relay 111 is electrically energized and thus its contacts 112 and 113 are closed.

FIG. 4 further shows a second control relay 114 in a line 116, and the relay 114 has two sets of electric contacts 117 and 118 which are schematically shown and are arranged in a conventional manner. Also, the limit switch 102 is shown connected with the line 116, and the switch is a normally open type of limit switch, and the limit switch 103 is also shown in the line 116 and it is a normally closed type of limit switch. With the arrangement shown and the energizing of the control relay 111, the current can pass through the limit switch 102 and that energizes the control relay 114 which closes the contacts 117 and 118. Further, the drawing shows the solenoid 101 connected with the relay 114, and the energizing of the relay 114 thus energizes the solenoid 101, and that shifts the closure or spool 84 shown in FIG. 3, to thus align the passageways 98 and 99 with the respective hydraulic lines connected with that control valve 84.

With the valve 84 shifted downwardly by energizing the solenoid 101, as described, hydraulic pressure in line 83 is directed to line 51 for pressurizing the head end of the cylinder assembly 36, while the return from the rod end of the assembly 36 can go through the valve passageway 98 and to the tank 52. As previously described, extending one of the cylinder assemblies causes the other to contract, and thus extending the cylinder assembly 36 causes the cylinder assembly 41 to contract, and the extension of cylinder assembly 36 also opens the limit switch 102 while control relay 114 remains closed since contacts 117 are closed and switch 103 is closed. Valve 64 is also closed, as described and at that time, and thus the pressure in line 47 will increase until the setting of the relief valve 96 is overcome by the pressure being exposed to the pilot line 119 of valve 96. Opening the valve 96 thus allows the hydraulic pressure in the head end of cylinder assembly 41 to be exhausted to the tank for return supply.

Next, continued extension of the cylinder assembly 36 causes the opening of the contacts in the limit switch 103 and therefore the current flowing to the control relay 114 is interrupted and thus the contacts 117 and 118 are opened and this results in the de-energizing of the solenoid 101. With the solenoid 101 de-energized, the valve spring 97 will of course shift the spool of the valve 84 and return it to the position shown in FIG. 3, and thus the cylinder assembly 36 will be caused to retract, while the cylinder assembly 41 will be caused to extend, and that reduces the hydraulic pressure in the line 67 and thus opens the valve 64 so that hydraulic pressure can pass through the valve 64 and into the head end of the cylinder assembly 41. Of course the valve 96 has again closed, when the pressure has sufficiently dropped in the valve 96 such as by the pressure relief action described with regard to valve 96, and therefore the cylinder assembly 41 can fully extend while the cylinder assembly 36 can fully retract and thereby have the limit switch 102 close to again re-energize the solenoid 101 to repeat the cycle, all in the automatic manner described.

The electric system also contains a switch 121 which is in the form of a stop button which the operator can activate to disconnect the entire electric system from the arrangement of the overall system shown and described. Of course with the inactivation of the electric system by the stop button 121, the solenoid 101 is de-energized and the cylinder assembly 36 is retracted and thus the cylinder assembly 41 will extend. Further, the described start and stop operations through the electric system can be accomplished at any point in the cycle described, regardless of the position of either of the cylinder assemblies 36 and 41. Also, when the stop button is actuated, the normal operation of cylinder assembly 41 can be performed while the utilization of the overall system with the operation of the cylinder assembly 36 will not be required nor made.

Further, the setting of the pressure on all of the pressure-activated valves disclosed is possible and is utilized in the operation and sequence of the systems, and also the location of the limit switches 102 and 103 will determine the cycle time and effectiveness of the entire system.

In summary, the system is arranged so that the bucket-actuating activity of the cylinder assembly 41 can be utilized alone, or both cylinder assemblies 36 and 41 can be utilized, through the use of the electric system described, and thus the oscillatory action on the bucket 33 is possible and that action is automatically accomplished.

What is claimed is:

1. An oscillatory electro-hydraulic system for a material handling bucket, comprising two hydraulic cylinder assemblies connected with said bucket to be mechanically connected relative to each other for pivoting said bucket, said cylinder assemblies being the double acting type and each including a cylinder portion and a rod extendable from the cylinder portion of each of said assemblies, a hydraulic pump hydraulically connected in separate respective connections to the head and rod ends of a first one of said cylinder assemblies, a hydraulic line hydraulically connected between said cylinder assemblies, a hydraulic control valve connected with said hydraulic line and having two pairs of hydraulic passageways with each pair thereof having one of said passageways separately selectively hydraulically connectable to one of the head and rod ends of the second one of said cylinder assemblies, for controlling hydraulic flow to the respective head and rod ends of said second one of said cylinder assemblies, and the other of said passageways in each of said pairs being a hydraulic return passageway, all for permitting hydraulic pressurizing and actuation of said first one of said cylinder assemblies while said second one of said cylinder assemblies is free to actuate without hydraulic pressure, an electric system operatively associated with both said control valve and one of said cylinder assemblies for operating said control valve, electric switch means included in said electric system and being arranged to be actuated in response to extension and contraction of said one of said cylinder assemblies to thereby actuate said control valve to direct hydraulic flow to and from the head and rod ends of said second cylinder assembly, and a second switch included in said electric system and being arranged to be actuated in response to extension and contraction of said one of said cylinder assemblies for electrically opening said electric system and leaving said control valve in an operative position where only one of said head and rod ends of said second cylinder assembly is hydraulically pressurized.

2. The oscillatory electro-hydraulic system as claimed in claim 1, including a hydraulic pressure actuated valve connected with said hydraulic line for controlling hydraulic flow to said second cylinder assembly and permitting the flow to said second cylinder assembly only after said one cylinder assembly is hydraulically pressurized by said pump.

3. The oscillatory electro-hydraulic system as claimed in claim 2, wherein said pressure actuated valve is a pressure relief valve arranged to present hydraulic pressure to said second cylinder assembly.

4. The oscillatory electro-hydraulic system as claimed in claim 3, including a pressure reducing valve connected with said hydraulic line and in a series connection with said pressure relief valve and said one cylinder assembly, for limiting the magnitude of the hydraulic pressure presented to said one cylinder assembly.

5. The oscillator electro-hydraulic system as claimed in claim 4, wherein said reducing valve is of a pressure responsive value less than that of said relief valve, to have said reducing valve actuate before said relief valve is actuated, and thereby actuate said one cylinder assembly before actuating said second cylinder assembly.

6. The oscillatory electro-hydraulic system as claimed in claim 1, including an additional hydraulic control valve hydraulically connected between said pump and said first one of said cylinder assemblies for two-way flow of hydraulic fluid to the latter.

7. The oscillatory electro-hydraulic system as claimed in claim 6, wherein said hydraulic line connecting said cylinder assemblies is connected, and said control valve passageways are arranged, to normally have the head end of one of said two cylinder assemblies hydraulically connected to the rod end of the other of said two cylinder assemblies.

8. The oscillatory electro-hydraulic system as claimed in claim 1, wherein said hydraulic line is only a single hydraulic passageway extending between only one of said head and rod ends of said one cylinder assembly and said control valve, whereby said second cylinder assembly is hydraulically pressurized only in the event said one of said head and rod ends of said cylinder assembly is pressurized.

9. The oscillatory electro-hydraulic system as claimed in claim 8, including a hydraulic pressure activated reducing valve connected intermediate said pump and said one cylinder assembly, for limiting hydraulic pressure to said one cylinder assembly, and said hydraulic line being hydraulically connected between said reducing valve and said control valve, for directing hydraulic pressure to said second cylinder assembly only after the hydraulic pressure reaches the activation magnitude on said reducing valve.

10. The oscillatory electro-hydraulic system as claimed in claim 1, wherein said electric switch means includes two electric switches sequentially disposed in the path of movement of said one of said cylinder assemblies with which said switch means is operatively associated, for sequencing said control valve.

11. The oscillatory electro-hydraulic system as claimed in claim 1, wherein said control valve is a solenoid type of valve for actuating said control valve for controlling the fluid flow therethrough, and said electric switch means is operatively connected to the solenoid of said control valve and is disposed to be physically actuated in accordance with the extension and contraction of said one of said cylinder assemblies.

12. The oscillatory electro-hydraulic system as claimed in claim 1, wherein said electric switch means includes two electric switches sequentially disposed in the path of movement of said one of said cylinder assemblies with which said switch means is operatively associated, for sequencing said control valve, and said control valve is a solenoid type of valve for actuating said control valve for controlling the fluid flow therethrough, and said electric switch means is operatively connected to the solenoid of said control valve and is disposed to be physically actuated in accordance with the extension and contraction of said one of said cylinder assemblies.

13. The oscillatory electro-hydraulic system as claimed in claim 12, wherein said electric system includes electric control relays electrically connected with said switch means and capable of remaining electrically open and closed for respectively positioning said switch means electrically open and closed to provide a time interval for operation of said control valve.

* * * * *